US012158290B2

(12) United States Patent
Patterson et al.

(10) Patent No.: US 12,158,290 B2
(45) Date of Patent: Dec. 3, 2024

(54) ALUMINUM COMPRESSOR WITH SACRIFICIAL CLADDING

(71) Applicant: Carrier Corporation, Palm Beach Gardens, FL (US)

(72) Inventors: Matthew Patterson, East Syracuse, NY (US); Anais Espinal, Burlington, MA (US); Mark R. Jaworowski, Sarasota, FL (US); Catherine Thibaud, Cork (IE); Aaron T. Nardi, East Granby, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 956 days.

(21) Appl. No.: 16/972,043

(22) PCT Filed: Dec. 19, 2019

(86) PCT No.: PCT/US2019/067441
§ 371 (c)(1),
(2) Date: Dec. 4, 2020

(87) PCT Pub. No.: WO2020/132222
PCT Pub. Date: Jun. 25, 2020

(65) Prior Publication Data

US 2021/0293457 A1 Sep. 23, 2021

Related U.S. Application Data

(60) Provisional application No. 62/781,944, filed on Dec. 19, 2018.

(51) Int. Cl.
*F25B 1/02* (2006.01)
*F04B 39/12* (2006.01)

(52) U.S. Cl.
CPC ..... *F25B 1/02* (2013.01); *F04B 39/121* (2013.01)

(58) Field of Classification Search
CPC ..... F04C 2230/90; F04C 2230/228004
See application file for complete search history.

(56) References Cited

U.S. PATENT DOCUMENTS 3,010,843 A 11/1961 Eder
3,961,868 A * 6/1976 Droege, Sr. ..... F04B 35/04 92/155

(Continued)

FOREIGN PATENT DOCUMENTS

CN 2362869 Y 2/2000
CN 1924098 A 3/2007

(Continued)

OTHER PUBLICATIONS

Galvanic Series Chart, https://fairwindfasteners.com/blogs/news/galvanic-series-or-nobility-chart-for-dissimilar-metals, 1 page, downloaded Mar. 15, 2024. (Year: 2024).*

(Continued)

*Primary Examiner* — Charles G Freay
*Assistant Examiner* — David N Brandt
(74) *Attorney, Agent, or Firm* — CANTOR COLBURN LLP

(57) ABSTRACT

A compressor is disclosed, including an outer casing and a fluid guide around a cavity within the casing. An inlet is in operative fluid communication with the cavity, and an outlet is also in operative fluid communication with the cavity. A prime mover includes an actuator disposed in the cavity. The actuator includes a surface arranged to receive fluid in the cavity from the inlet, impart compression to received fluid in the cavity, and discharge compressed fluid to the outlet. A surface of the compressor includes a cladding of a second (Continued)

aluminum alloy over a core of a first aluminum alloy, wherein the second aluminum alloy is less noble than the first aluminum alloy and includes an alloying element selected from tin, indium, gallium, or combinations thereof.

20 Claims, 8 Drawing Sheets

(56) References Cited

U.S. PATENT DOCUMENTS

| | | | | |
|---|---|---|---|---|
| 3,962,061 | A | 6/1976 | Nikaido et al. | |
| 4,456,663 | A | 6/1984 | Leonard | |
| 4,888,218 | A | 12/1989 | Suzuki et al. | |
| 5,080,056 | A * | 1/1992 | Kramer | F02F 7/0007 29/888.048 |
| 5,432,011 | A | 7/1995 | Dubois et al. | |
| 5,911,809 | A | 6/1999 | Cordy | |
| 6,217,295 | B1 * | 4/2001 | Kato | F04B 27/0878 92/155 |
| 6,378,415 | B1 | 4/2002 | Sugiura et al. | |
| 6,706,415 | B2 | 3/2004 | Cooper et al. | |
| 6,866,941 | B2 * | 3/2005 | Cooper | C23C 28/00 428/548 |
| 8,246,330 | B2 * | 8/2012 | Ay | F04B 39/125 417/313 |
| 9,243,333 | B2 | 1/2016 | Matzdorf et al. | |
| 2007/0289490 | A1 * | 12/2007 | Jabado | C23C 22/74 106/286.6 |
| 2009/0297720 | A1 | 12/2009 | Ramgopal et al. | |
| 2010/0124616 | A1 | 5/2010 | Rosenzweig et al. | |
| 2010/0291400 | A1 * | 11/2010 | Ahl | B32B 15/016 428/576 |
| 2011/0256389 | A1 | 10/2011 | Dendis | |
| 2013/0327212 | A1 * | 12/2013 | Ficht | F02F 1/004 92/172 |
| 2019/0338774 | A1 | 11/2019 | Shimozono et al. | |

FOREIGN PATENT DOCUMENTS

| | | | |
|---|---|---|---|
| CN | 102002715 | A | 4/2011 |
| CN | 102808186 | A | 12/2012 |
| CN | 103774154 | A | 5/2014 |
| CN | 104177986 | A | 12/2014 |
| EP | 1679388 | A1 | 7/2006 |
| EP | 3492741 | A1 | 6/2019 |
| JP | H05220450 | A | 8/1993 |
| KR | 100951439 | B1 | 4/2010 |
| WO | 2014150508 | A1 | 9/2014 |
| WO | 2017149030 | A1 | 9/2017 |
| WO | 2020132222 | A1 | 6/2020 |

OTHER PUBLICATIONS

International Search Report for International Application No. PCT/US2019/067441; Application Filing Date: Dec. 12, 2019; Date of Mailing: May 4, 2020; 6 pages.

Swanson, Dan. TechLink. Aluminum alloy for paints, anodes, and sacrificial coatings. Retrieved from: <https://techlinkcenter.org/technologies/aluminum-alloy-for-paints-bulk-anodes-and-sacrificial-coatings/>. Date Accessed: Aug. 27, 2018, 3 Pages.

Written Opinion for International Application No. PCT/US2019/067441; Application Filing Date: Dec. 12, 2019; Date of Mailing: May 4, 2020; 8 pages.

* cited by examiner

ALUMINUM COMPRESSOR WITH SACRIFICIAL CLADDING

CROSS REFERENCE TO RELATED APPLICATIONS

This application is a National Stage application of PCT/US2019/067441, filed Dec. 19, 2019, which claims the benefit of U.S. Provisional Application No. 62/781,944, filed Dec. 19, 2018, both of which are incorporated by reference in their entirety herein.

BACKGROUND

Exemplary embodiments pertain to the art of compressor and, more specifically, to aluminum alloy compressors.

Compressors are used in various fluid processing operations, including various industrial and residential applications. One common application for compressors is in cooling or other heat pump applications involving compressible fluid refrigerants. Compressors are often subject to corrosion. For example, compressors disposed in marine environments can be subject to external corrosion. Corrosion can degrade the structural integrity of compressor components, and failure of those containing high pressure fluids can lead to unwanted repairs, safety risk, and fluid loss, as well as environmental and clean-up risks from leaked fluids. Elevated temperatures can also pose issues a problem in compressors. Certain components (e.g. compressor heads and discharge shells) can operate at temperatures in excess of 150° C., which can limit the use of organic coatings to provide corrosion protection.

BRIEF DESCRIPTION

A compressor is disclosed, including an outer casing and a fluid guide around a cavity within the casing. An inlet is in operative fluid communication with the cavity, and an outlet is also in operative fluid communication with the cavity. A prime mover includes an actuator disposed in the cavity. The actuator includes a surface arranged to receive fluid in the cavity from the inlet, impart compression to received fluid in the cavity, and discharge compressed fluid to the outlet. A surface of the compressor includes a cladding over a core, with the core comprising a first aluminum alloy, and the cladding comprising a second aluminum alloy. The second aluminum alloy is less noble than the first aluminum alloy and comprises an alloying element selected from tin, indium, gallium, or combinations thereof.

In some embodiments, the cladding is disposed on a surface of the outer casing.

In any one or combination of the foregoing embodiments, the cladding is disposed on a surface of the fluid guide around the cavity.

In any one or combination of the foregoing embodiments, the cladding is disposed on a surface of the actuator.

In any one or combination of the foregoing embodiments, the cladding is disposed on a surface of the inlet or on a surface of the outlet.

In any one or combination of the foregoing embodiments, the cladding comprises a cast aluminum alloy.

In any one or combination of the foregoing embodiments, the prime mover is disposed within the outer casing.

In any one or combination of the foregoing embodiments, the prime mover is disposed outside of the outer casing, in operative mechanical communication with the actuator within the outer casing.

In any one or combination of the foregoing embodiments, the actuator is selected from a reciprocating piston, a rotary screw, a scroll, a rotary vane, or an impeller.

In any one or combination of the foregoing embodiments, the second alloy further comprises zinc or magnesium.

Also disclosed is a heat transfer system comprising a heat transfer fluid circulation loop includes a compressor, a heat rejection heat exchanger in thermal communication with a heat sink, an expansion device, and a heat absorption heat exchanger in thermal communication with a heat source, connected together in order by conduit, wherein the compressor is according to any one or combination of the foregoing embodiments.

In some embodiments, the heat source is an indoor conditioned air space and the heat sink is an outdoor air space.

In any one or combination of the foregoing heat transfer system embodiments, the compressor is in disposed in the outdoor air space.

In any one or combination of the foregoing heat transfer system embodiments, the compressor is an indoor air space separate from the conditioned air space, and is exposed to an external source of moisture.

In any one or combination of the foregoing heat transfer system embodiments, the heat transfer fluid circulation loop is configured for an operational pressure of less than atmospheric pressure in at least a portion of the heat transfer fluid circulation loop.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
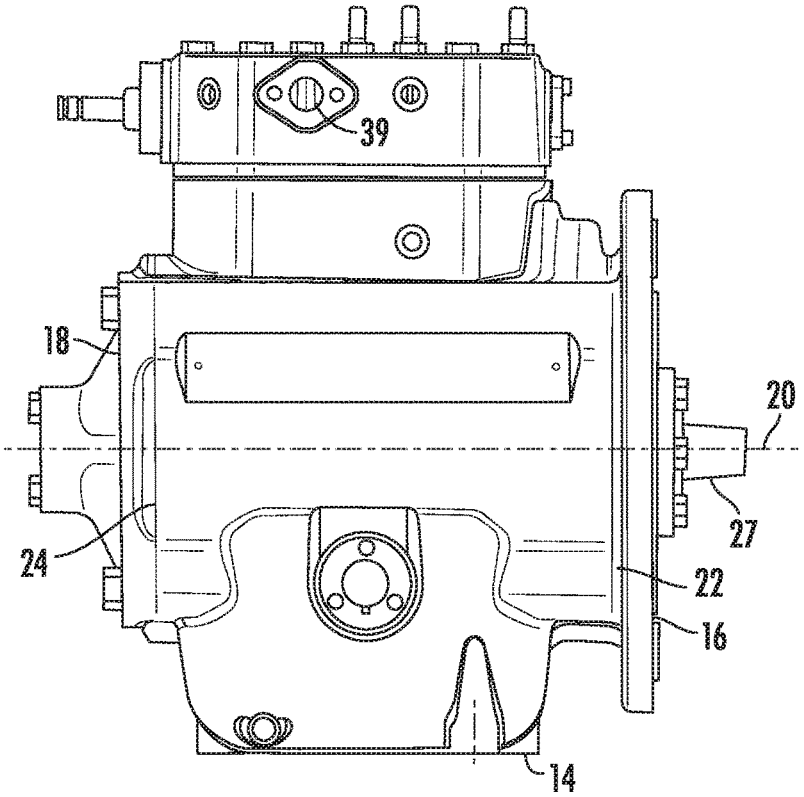
FIGS. 1 and 2 each schematically shows a different view of an example embodiment of a reciprocating piston compressor with an external drive.

A detailed description of one or more embodiments of the disclosed apparatus and method are presented herein by way of exemplification and not limitation with reference to the Figures.

As mentioned above, a compressor includes an outer casing, a fluid guide around a cavity within the outer casing, an inlet and outlet in operative fluid communication with the cavity, and a prime mover including an actuator in the cavity arranged to compress fluid. The above components are the main components of the compressor, but the compressor can of course include numerous additional components, subcomponents, and features not listed above. For example, in some embodiments, the fluid guide includes not only a cavity or cavity within which the actuator is situation, but also one or more sections around flow paths between the inlet and the actuator cavity or between the actuator cavity and the outlet. Also, in some embodiments, the fluid guide (or components thereof) can be distinct components disposed and directly or indirectly attached or mounted to the casing. In some embodiments, the fluid guide can integrated with the outer casing, such as in embodiments where the outer casing (which can be formed from a cast metal) includes a wall having an exterior surface that is the exterior of the compressor and an interior surface that serves as a fluid guide. Additionally, various types of actuators can be utilized, including but not limited to reciprocating pistons, rotary screws, scrolls, rotary vanes, or impellers. Example embodiments of different types of compressors and arrangements of components are shown below in FIGS. 1-5.

With reference now to FIGS. 1-4, example embodiments of reciprocating piston compressor are schematically shown. As shown in FIGS. 1-4, a reciprocating compressor 10 includes a casing main body 12, a base 14, a first casing end cover 16 and a second casing end cover 18. The casing main body 12 extends generally along a longitudinal axis 20 from an open first end 22 that receives the first casing end cover 16 to an open second end 24 that receives the second casing end cover 18. The reciprocating compressor 10 includes a crankshaft 26 disposed for rotation about the axis 20. A plurality of pistons 36 are connected by piston rods to the crankshaft 26 in a conventional manner for linear translation motion within respective cylinders 38 within the crankcase 32. In operation, the crankshaft 26 is driven in rotation about the axis 20 which translates into reciprocating linear movement of the pistons 36 within their respective cylinders 38. A gaseous fluid, such as for example refrigerant vapor, is drawn into the chamber 35 of a cylinder 38 during an intake stoke as the piston 36 disposed therein is moving away from the cylinder head. The gaseous fluid drawn into the cylinder chamber 35 is compressed during a compression stroke as the piston 36 moves toward the cylinder head, and the compressed gaseous fluid is discharged from the cylinder chamber 35 through an outlet 39 during a discharge stroke.

Figure 2:
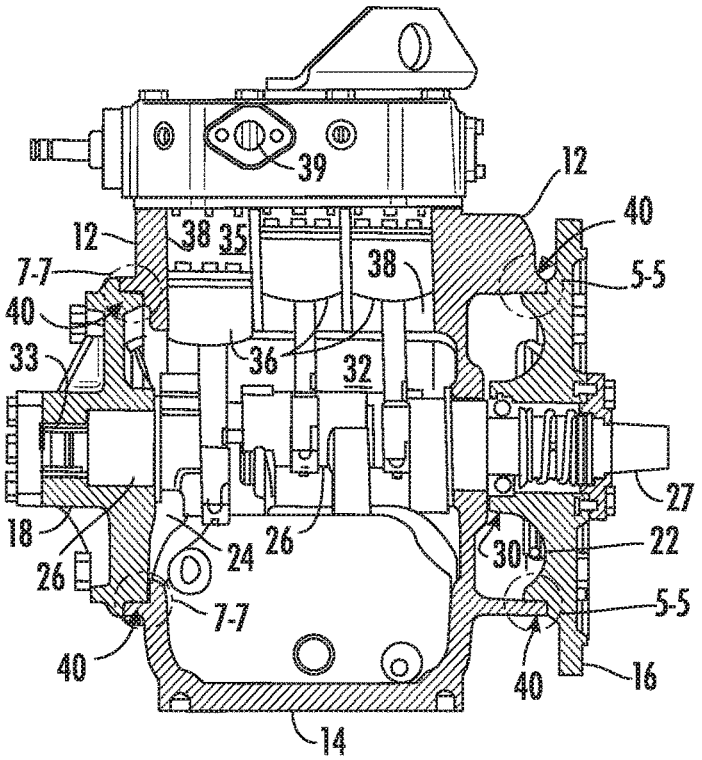

In the open-drive embodiment of the reciprocating compressor 10 as depicted in FIG. 2, the crankshaft 26 extends longitudinally from an end 27 disposed outside the casing main body 12 of the compressor 10, through a central bore in the first casing end cover 16, through a first end bearing 30, thence through the crankcase 32 and into a second end bearing 33 supported by the second end cover 18. In operation, the crankshaft 26 is driven in rotation by an external driver (not shown), such as for example a motor or an engine, connected to the end 27 of the crankshaft 26 outside the first casing end cover 16.

Figure 4:
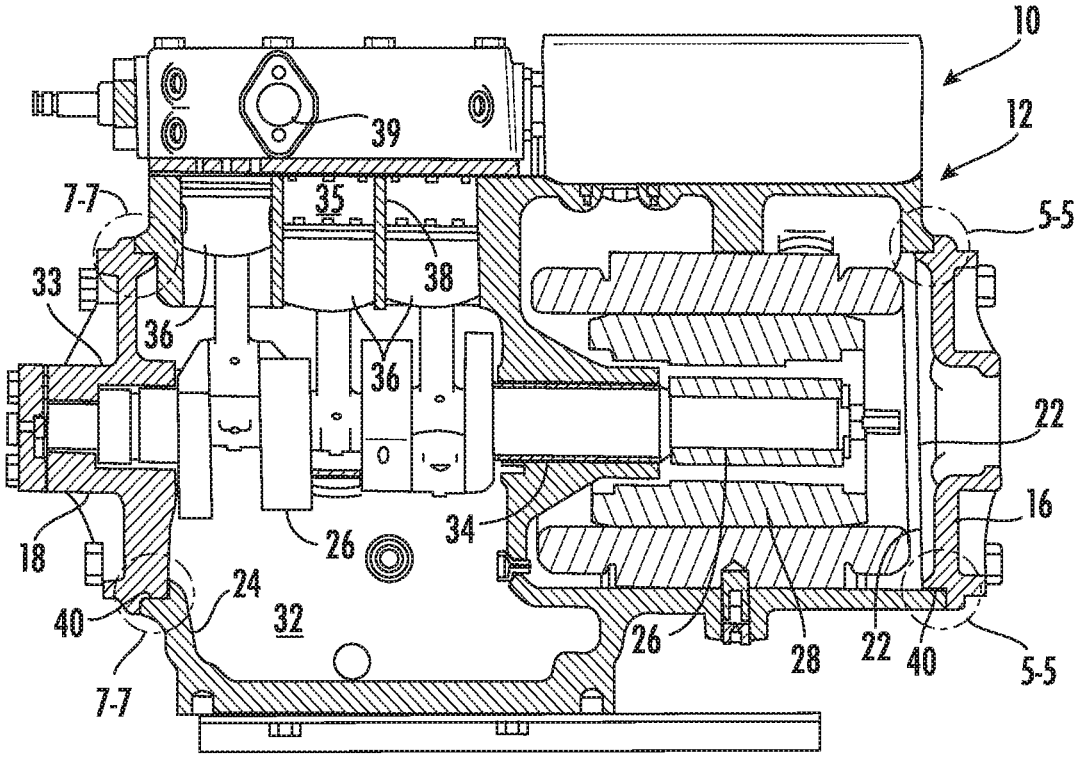

In the closed drive embodiment of the reciprocating compressor 10 as depicted in FIG. 4, the crankshaft 26 is housed entirely within the compressor 10. The crankshaft 26 extends longitudinally from a first end disposed within a drive motor 28 mounted about the crankshaft 26, through a main bearing 34, thence through the crankcase 32 and into an end bearing 33 supported by the second end cover 18. In operation, the crankshaft 26 is driven in rotation by the motor 28, which is powered by electric current supplied from an external source.

To prevent leakage of the higher pressure interior of the main casing 12, it is necessary to seal the respective interfaces between the open ends 22, 24 of the casing main body 12 and the respective first and second casing end covers 16, 18. The reciprocating compressor 10 includes a sealing arrangement 40 at both ends of the casing main body 12 for sealing the interface between the first end cover 16 and the first open end 22 of the casing main body 12 and for sealing the interface between the second end cover 18 and the second open end 24 of the casing main body 12.

Figure 5:
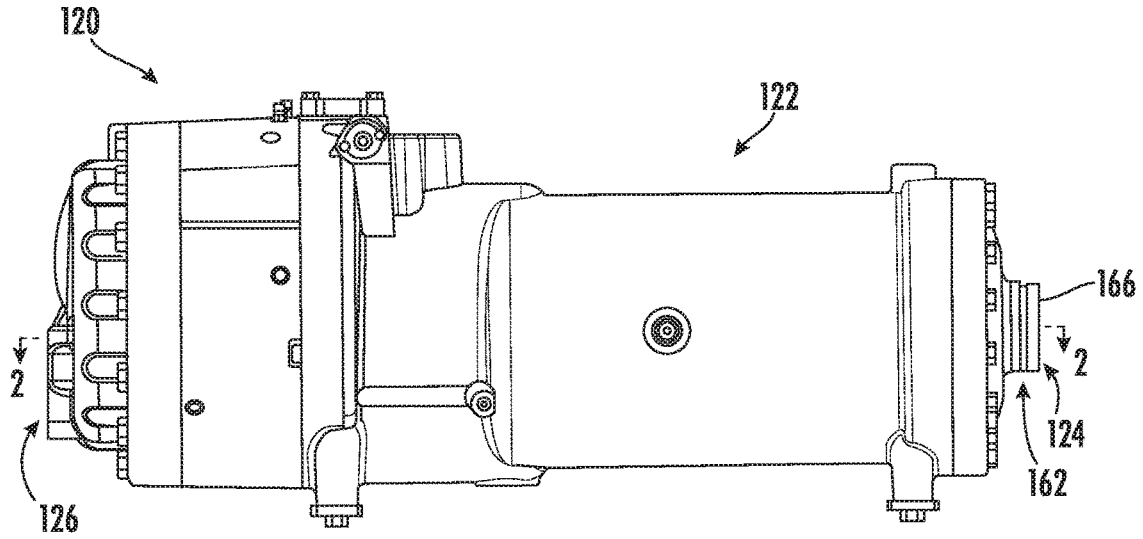
FIGS. 5, 6, and 7 each schematically shows a different view of an example embodiment of a rotary screw compressor.
Figure 6:
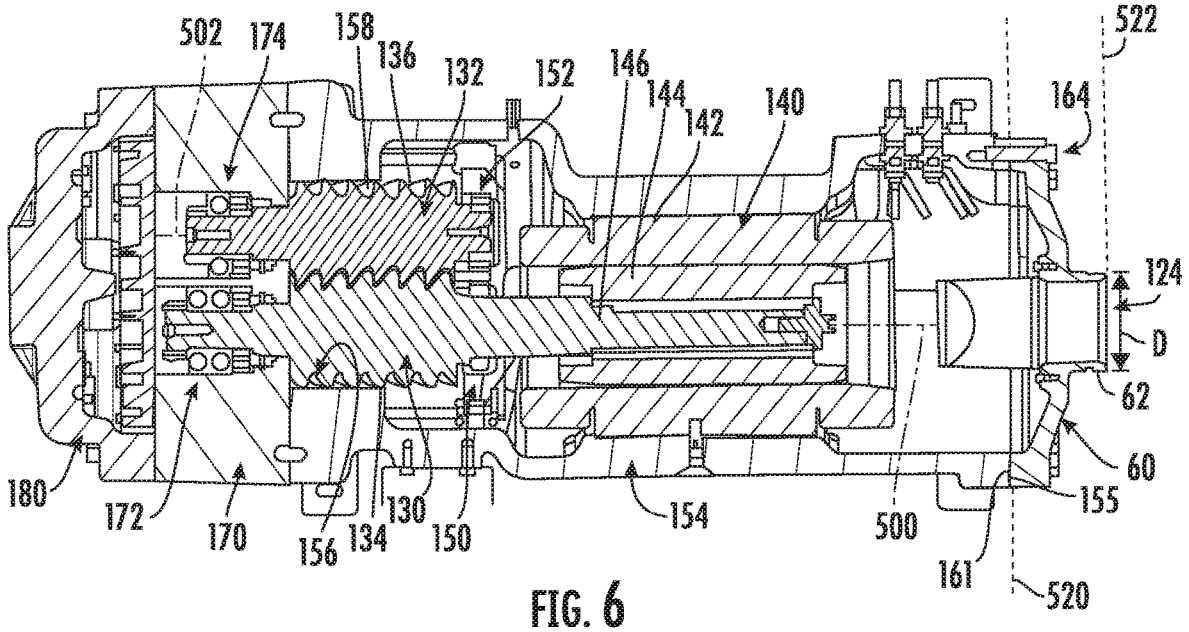
Figure 7:
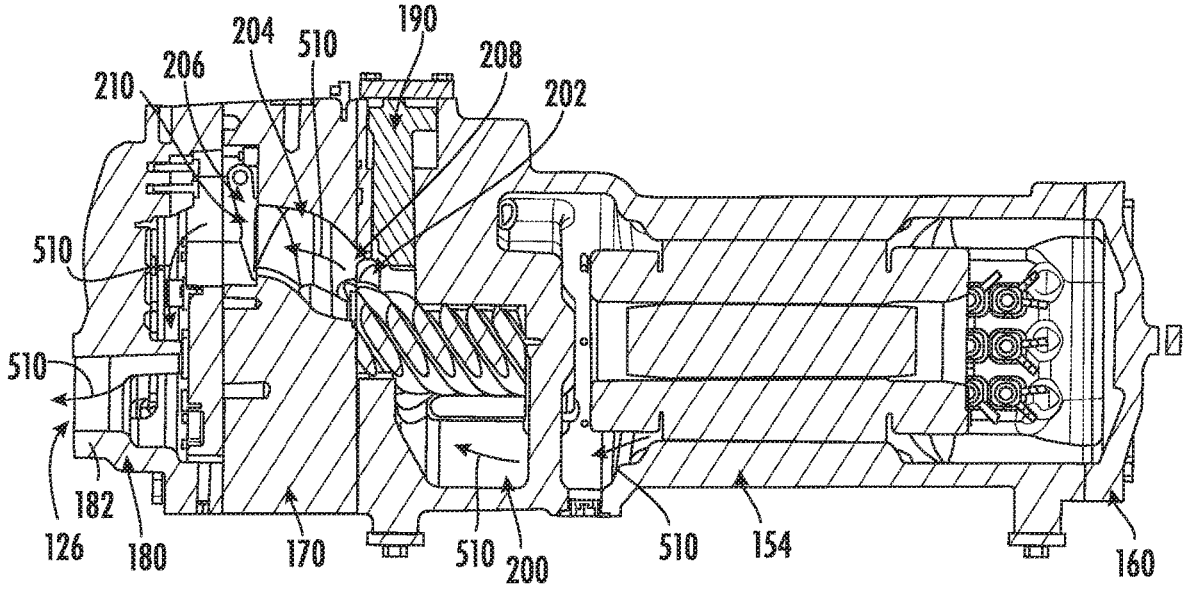

FIGS. 5-7 schematically show an example embodiment of a rotary screw compressor 120 having a housing or case (case assembly) 122 including an inlet or suction port 124 and an outlet or discharge port 126. The exemplary suction port 124 and discharge port 126 are axial ports (facing in opposite directions parallel to rotor axes). The case assembly comprises several main pieces which may be formed of cast or machined alloy. FIG. 6 shows a cross-section of an exemplary compressor as being a screw compressor, more particularly, a two-rotor direct drive semi-hermetic screw compressor. The exemplary screws are a respective male rotor 130 and female rotor 132. The male rotor has a lobed working portion 134. The female rotor has a lobed working portion 136 enmeshed with the male rotor working portion 134. In the exemplary embodiment, the male rotor is driven for rotation about an axis 500 by a motor 140 having a stator 142 and a rotor 144. The exemplary drive is direct drive with an upstream shaft 146 of the male rotor mounted in the rotor 144. The driving of the male rotor causes the cooperation between lobes to, in turn, drive rotation of the female rotor about its axis 502.

The exemplary rotors are supported for rotation about their respective axes by one or more bearings (e.g., rolling element bearings) along shaft portions protruding from opposite ends of each such rotor working portion. In an exemplary embodiment, upstream end bearings 150 and 152, respectively, are mounted in associated compartments in a main casting (main case member) 154 of the case assembly which forms a rotor case and the body of a motor case. The rotor case portion defines respective bores 156 and 158 accommodating the lobed working portions. At an upstream end of the motor case portion, a motor case cover or endplate 160 encloses the motor case and provides the inlet port such as via an integral fitting 162. The exemplary cover 160 is secured to the upstream end of the main case member 154 via a threaded fastener (screw/bolt) 164 circle (e.g., at least 8 fasteners, more specifically, 15 to 40 or 20 to 35) extending through a flange of the cover and into threaded bores of the main case member. A mounting face 161 of a mounting portion 163 of the cover is mated to the inlet/suction end face 155 of the case member 154. 1A web 165 extends inward and outward/upstream from the mounting portion 163 to the fitting 162. A mating plane 520 is shown between the cover and case member 154. There may be a gasket (not shown) along the mating plane. The case opening at the end face 155 is large enough to pass the motor. An inlet filter 169 is also shown, fastened (e.g., screwed) to the inboard face of the cover. A plane 522 is shown of a rim surface or end 166 of the fitting.

Figure 3:
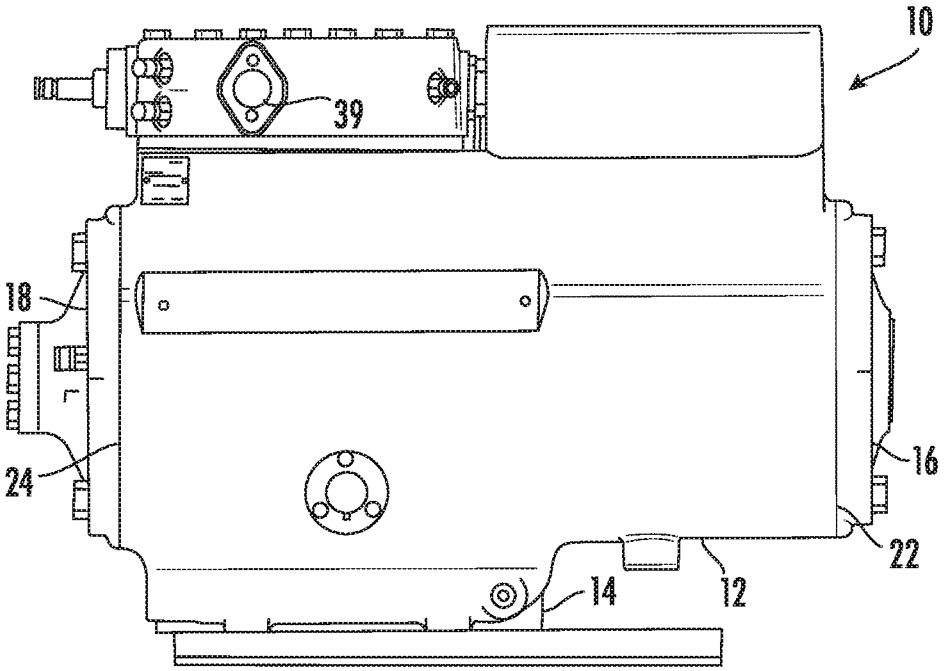
FIGS. 3 and 4 each schematically shows a different view of an example embodiment of a reciprocating piston compressor with an internal drive.

At the downstream end of the main case member 154, the case assembly includes a separate bearing case member (discharge end bearing case) 170 which has bearing compartments in which the respective discharge end bearings 172 and 174 of the male rotor and female rotor are mounted. A discharge case (cover or endplate) 180 may cover the bearing case 170 and may provide the discharge port such as via a fitting 182 (FIG. 3). The discharge cover 180 may be secured such as via a threaded fastener circle. In one exemplary implementation, the fasteners extend through the bearing case to the main case member 154 downstream end.

In operation, the exemplary flowpath 510 through the compressor passes from the suction port 124 through the motor case (around and/or through the motor), into a suction plenum 200 (FIG. 7) of the rotor case and then through the enmeshed rotors wherein flow is compressed. The flowpath passes into a discharge plenum 202 portion of the rotor case and then through a discharge passageway 204 of the bearing case which forms an extension of the discharge plenum. A discharge valve 206 (e.g., a spring-loaded flapper valve) may control flow through the discharge plenum to prevent backflow. In the exemplary embodiment, the passageway 204 radially diverges from an inlet end 208 to an outlet end 210 so that the outlet end is at a relatively outboard location in the bearing case 170. This location is substantially offset from the discharge port 126 (e.g., approximately diametrically offset with the exemplary nominal circular planform of the bearing case and discharge cover). In the exemplary embodiment, the end 210 is at the twelve o'clock position looking upstream while the discharge port 126 is at the six o'clock position. This offset causes the flowpath to need to proceed transversely downward from the end 210 and valve 206 to get to the discharge port. This offset breaks line-of-sight between the discharge plenum and the discharge port to help dissipate pulsations generated by the opening of compression pockets to the discharge plenum FIG. 7 also shows a Vi piston 190.

Figure 9:
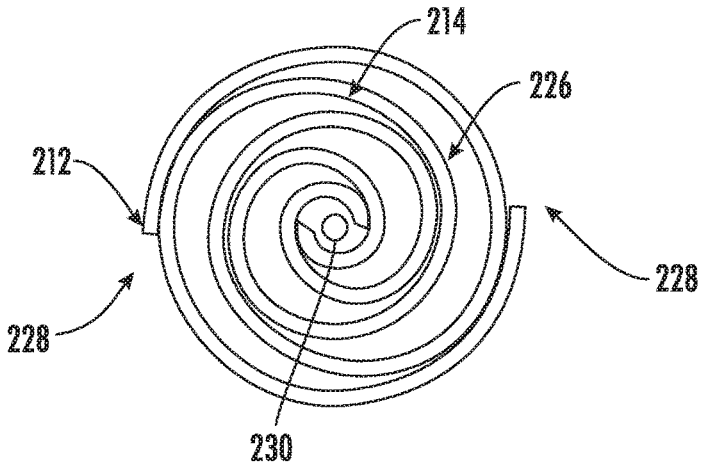
FIGS. 8 and 9 each schematically shows a different view of an example embodiment of a scroll compressor.
Figure 8:
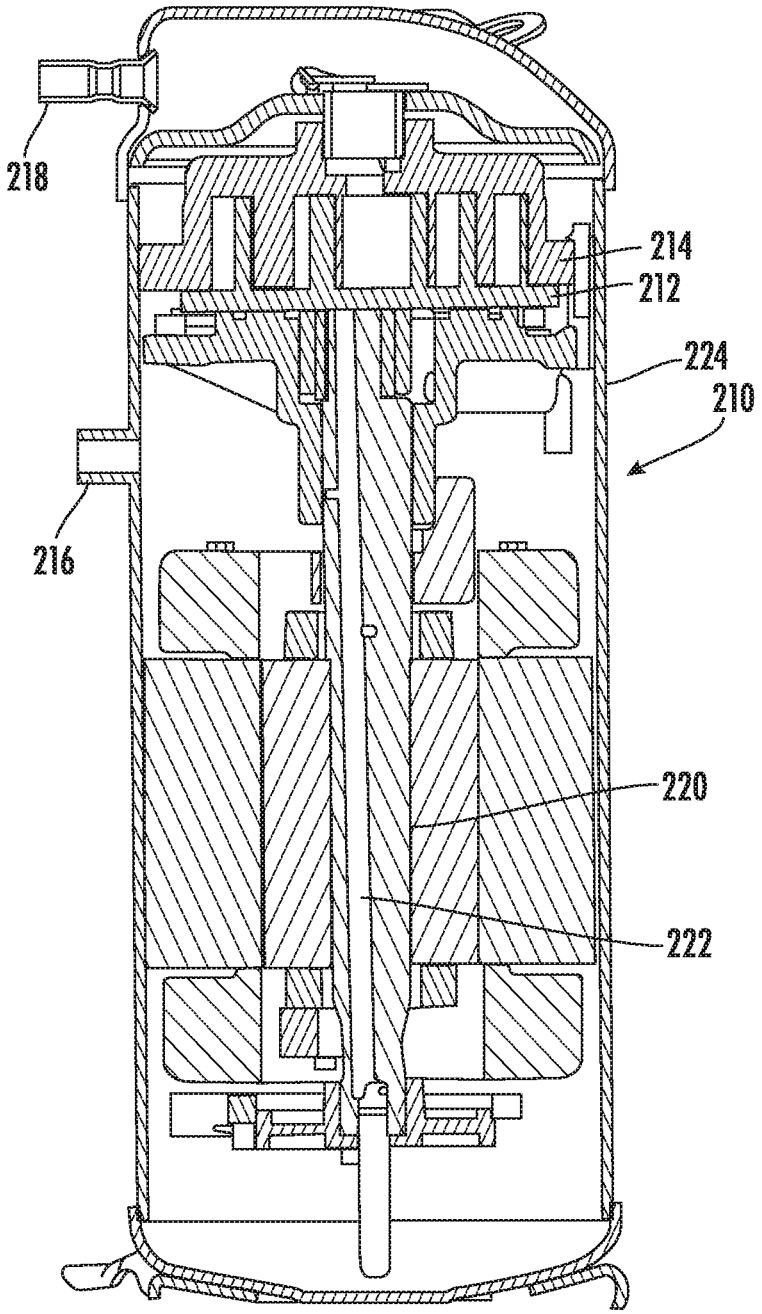

FIG. 8 schematically shows an example embodiment of a scroll compressor 210, which incorporates an orbiting scroll 212 and a non-orbiting scroll 214, inlet 216, outlet 218, motor 220, and drive shaft 222, in an outer casing 224. FIG. 9 schematically shows a cross-sectional view of the orbiting scroll 212 and non-orbiting scroll 214 with a compression chamber 226 in the interstitial space between the orbiting scroll 212 and the non-orbiting scroll 214. During operation, orbital motion of the orbiting scroll relative causes a reduction in volume of portions of the compression chamber 216, causing compression of the fluid disposed therein and transport of the fluid from the scroll inlet 228 to the scroll outlet 230.

Figure 10:
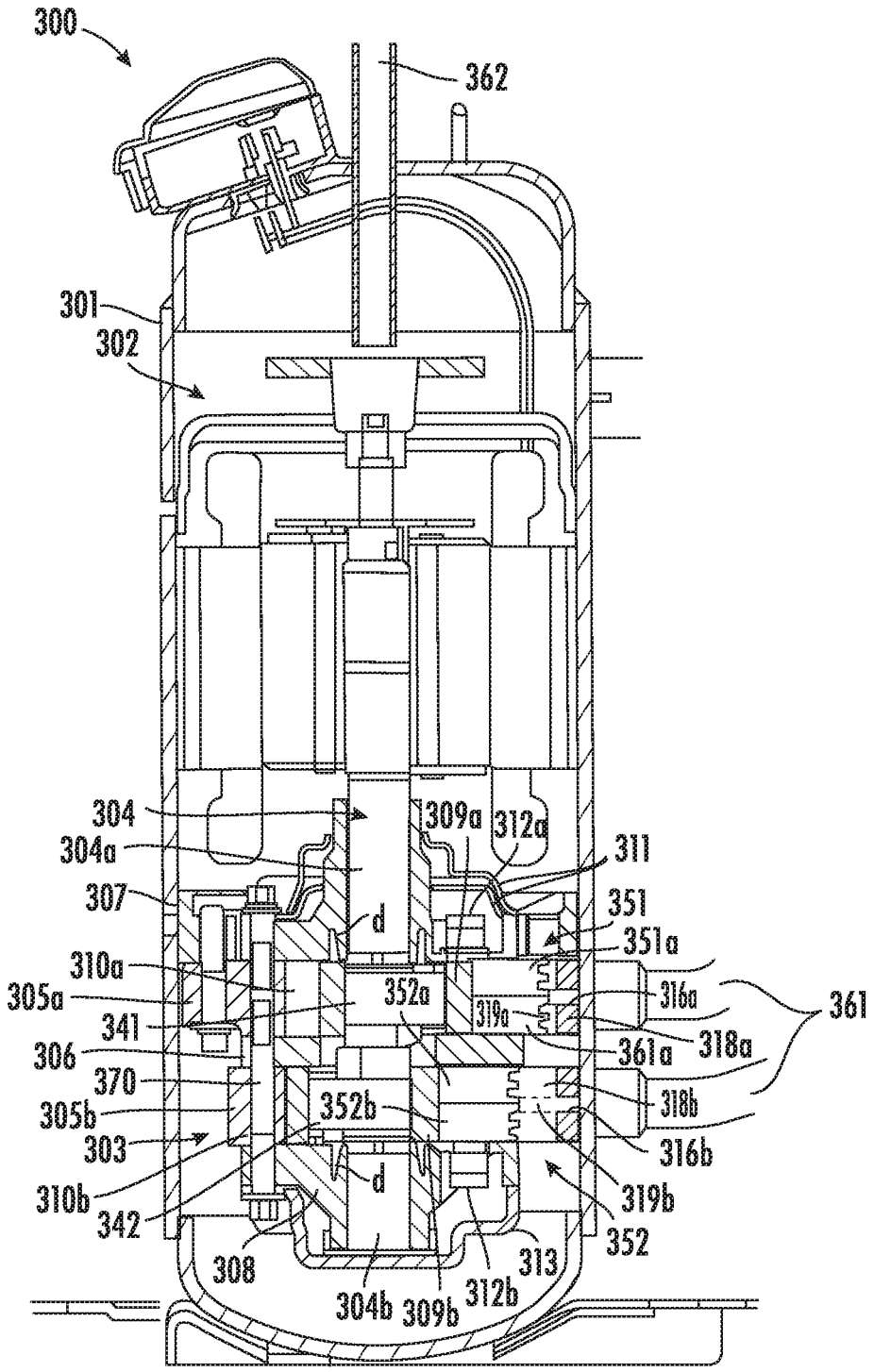
FIGS. 10 and 11 each schematically shows a different view of an example embodiment of a rotary vane compressor.

FIG. 10 shows a two-cylinder rotary compressor 300 in a cross-sectional view. As shown in FIG. 10, the rotary compressor 300 an electric motor unit 302, a compression mechanism unit 303, a rotational axis 304, a main bearing 307 and a sub-bearing 308 housed in a sealed case 301. The electric motor unit 302 is disposed in the upper part of the sealed case 301, and the compression mechanism unit 303 is provided in the lower part of the sealed case 301. The lower part of the sealed case 301 is filled with a lubricating oil, with the bulk of the compression mechanism unit 303 located in the lubricating oil. The electric motor unit 302 and the compression mechanism unit 303 are connected to each other via the rotational axis 304, which delivers mechanical power generated by the electric motor unit 302 to the compression mechanism unit 303. The compression mechanism unit 303 comprises a first cylinder 305*a* in the upper part and a second cylinder 305*b* in the lower part. An intermediate partition plate 306 is interposed between the first cylinder 305*a* and the second cylinder 305*b*. A main axis portion 304*a* of the rotational axis 304 is pivotably and rotatably supported by the main bearing 307. A sub-axis portion 304*b* of the rotational axis 304 is pivotably and rotatably supported by the sub-bearing 308. The rotational axis 304 includes a first eccentric portion 341 and a second eccentric portion 342. The first eccentric portion 341 is housed in a first cylinder chamber 310*a* of the first cylinder 305*a*. The second eccentric portion 342 is housed in a second cylinder chamber 310*b* of the second cylinder 315*b*. The first eccentric portion 341 and the second eccentric portion 342 have the same diameter and a phase difference of substantially 180° and are positioned out of alignment with each other.

A first roller 9*a* fits in the peripheral wall of the first eccentric portion 341 and is housed in the first cylinder chamber 310*a* of the first cylinder 35*a*. A second roller 309*b* fits in the peripheral wall of the second eccentric portion 342 and is housed in the second cylinder 305*b*. In association with rotation of the rotational axis 304, the first and second rollers 309*a* and 309*b* eccentrically rotate while their peripheral walls partially come into contact with the peripheral walls of the first cylinder chamber 310*a* and the second cylinder chamber 310*b*, respectively. A pair of discharge mufflers 311 is attached to the main bearing 307, and cover a discharge valve mechanism 312*a* provided in the main bearing 307. A discharge muffler 313 is attached to the sub-bearing 8, and covers a discharge valve mechanism 312*b* provided in the sub-bearing 308.

A discharge gas guide path is provided over the sub-bearing 308, the second cylinder 305*b*, the intermediate partition plate 306, the first cylinder 305*a* and the main bearing 307. The gaseous refrigerant discharged to discharge muffler 313 is guided into the double discharge mufflers 311 in the upper part through the above discharge gas guide path, is mixed with the gaseous refrigerant discharged through discharge valve mechanism 312*a* and is discharged into the sealed case.

A first vane unit 351 is provided in the first cylinder 305*a*, including a first vane 351*a* and a second vane 351*b*. The posterior end portions of the first and second vanes 351*a* and 351*b* come into contact with an end portion of a coil spring 316*a*. Coil spring 316*a* biases the first and second vanes 351*a* and 351*b* toward the first roller 339*a* such that the end portions of the first and second vanes 351*a* and 351*b* come into contact with the outer peripheral surface of the first roller 309*a*. A vane groove 317*a* which opens in the first cylinder chamber 310*a* is provided in the first cylinder 305*a*. The first cylinder 305*a* also includes a vane back chamber 318*a* in the posterior end portion of vane groove 317*a*, which opens in the sealed case 301 so that the posterior ends of the first and second vanes 351*a* and 351*b* are influenced by the pressure in the sealed case 301. A spring housing hole 19*a* is provided on the outer peripheral wall of the first cylinder 5*a*, to the extent of the first cylinder chamber 310*a* side via vane back chamber 318.

A second vane unit 352 is provided in the second cylinder 305*b*. The second vane unit 352 comprises a first vane 352*a* and a second vane 352*b*. The first vane 352*a* and the second vane 352*b* overlap each other in the height direction of the second cylinder 305*b*. The posterior portions of the first and second vanes 352*a* and 352*b* come into contact with an end portion of a coil spring 316*b* which biases the first and second vanes 352*a* and 352*b* toward the second roller 309*b* such that the apical end portions of the first and second vanes 352*a* and 352*b* come into contact with the outer peripheral surface of the second roller 309*b*. A vane groove 317*b* which opens in the second cylinder chamber 310*b* is provided in the second cylinder 305*b*, and the second cylinder 305*b* includes a vane back chamber 318*b* in the posterior end portion of vane groove 317*b*. The vane back chamber 318*b* opens in the sealed case 301 so that the posterior ends of the first and second vanes 352*a* and 352*b* are influenced by the pressure in the sealed case 301. A spring housing hole 319*b* is provided on the outer peripheral wall of the second cylinder 305*b*, to the extent of the second cylinder chamber 10*b* side via vane back chamber 18*b*.

During operation, discharge valve mechanism 312*a* of the main bearing 307 communicates with the first cylinder chamber 310*a*. When the pressure in the first cylinder chamber 310*a* has reached a predetermined pressure after increase in association with a compression influence, discharge valve mechanism 312*a* opens and discharges the compressed gaseous refrigerant into discharge mufflers 311. Discharge valve mechanism 312*b* of the sub-bearing 308 communicates with the second cylinder chamber 310*b*. When the pressure in the second cylinder chamber 310*b* has reached a predetermined pressure after increase in association with a compression influence, discharge valve mechanism 312*b* opens and discharges the compressed gaseous refrigerant into discharge muffler 313. If the pressure in the sealed case 301 is low and is not enough to press the first and second vanes 351*a* and 351*b* onto the first roller 309*a* at the time of activation, coil spring 16*a* biases the first and second vanes 351*a* and 351*b* toward the first roller 309*a*. This mechanism is also applied to coil spring 316*b*.

Figure 11:
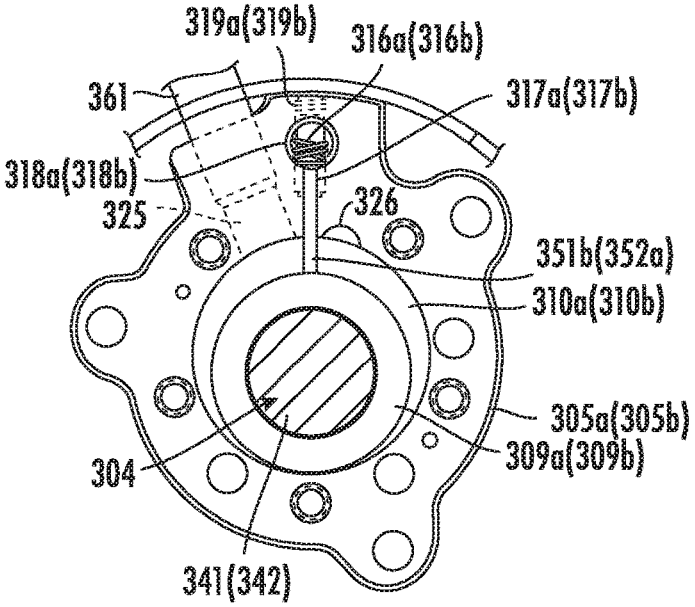

FIG. 11 is a plan view showing the first cylinder chamber 310*a* from FIG. 10 and its vicinity, and also representative of the second cylinder chamber 310*b*. In FIG. 11, the reference numbers of the second cylinder chamber 310*b* and the structures provided in its vicinity are put in parentheses and described beside the reference numbers of the first cylinder chamber 310*a* and the structures provided in its vicinity to also explain the second cylinder chamber 310*b* and the structures provided in its vicinity. As shown in FIG. 11, an absorption hole 325 is provided from the sealed case 1 and the outer peripheral wall of the first cylinder 305*a* to the first cylinder chamber 310*a*. In a similar manner, the inlet hole 325 is provided from the sealed case 301 and the outer peripheral wall of the second cylinder 305*b* to the second cylinder chamber 310*b*. The pipes are inserted into and secured to the above inlet holes 325. In the first and second cylinders 305*a* and 305*b*, the inlet holes are provided on one side of the circumferential direction of the first and second cylinders 305*a* and 305*b* with the first and second vane units 351 and 352 and grooves 317*a* and 317*b* being interposed. A discharge notch 326 which communicates with a discharge valve mechanism 312 is provided on the other side of the circumferential direction.

During operation, when the rotational axis 304 is rotationally driven in association with power distribution to the electric motor unit 302, the posterior ends of the first and second vanes 351*a* and 351*b* are influenced by the pressure in the sealed case 301 and the bias force of coil spring 316*a* in the first cylinder chamber 310*a*. By the bias force, the first and second vanes 351*a* and 351*b* elastically come into contact with the peripheral wall of the first roller 309*a*. In this manner, the first roller 309*a* eccentrically rotates. In a similar manner, in the second cylinder chamber 310*b*, the posterior ends of the first and second vanes 352*a* and 352*b* are influenced by the pressure in the sealed case 301 and the bias force of coil spring 316*b*. By the bias force, the first and second vanes 532*a* and 352*b* elastically come into contact with the peripheral wall of the second roller 309*b*. In this manner, the second roller 309*b* eccentrically rotates. In association with the eccentric rotation of the first and second rollers 309*a* and 309*b*, a gaseous refrigerant is introduced to the inlet 361 of the first and second cylinder chambers 310*a* and 310*b* partitioned by the first and second vane units 351 and 352. Moreover, the gaseous refrigerant is moved to the compression side of the first and second cylinder chambers 310*a* and 310*b* partitioned by the first and second vane units 351 and 352 and is compressed. When the pressure of the gaseous refrigerant is increased to a predetermined pressure in association with decrease in the volume on the compression side, the discharge valve mechanism 312 opens, and the gaseous refrigerant is discharged from the discharge hole 326.

The gaseous refrigerant discharged from the first cylinder chamber 310*a* and the gaseous refrigerant discharged from the second cylinder chamber 310*b* join in two discharge mufflers 11, and the joined gaseous refrigerant is discharged into the sealed case 301. The gaseous refrigerant discharged into the sealed case 301 fills the upper end portion of the sealed case 301 through the gas guide path provided among the components of the electric motor unit 302, and is discharged from the outlet 362 to the outside of the rotary compressor 300.

Figure 12:
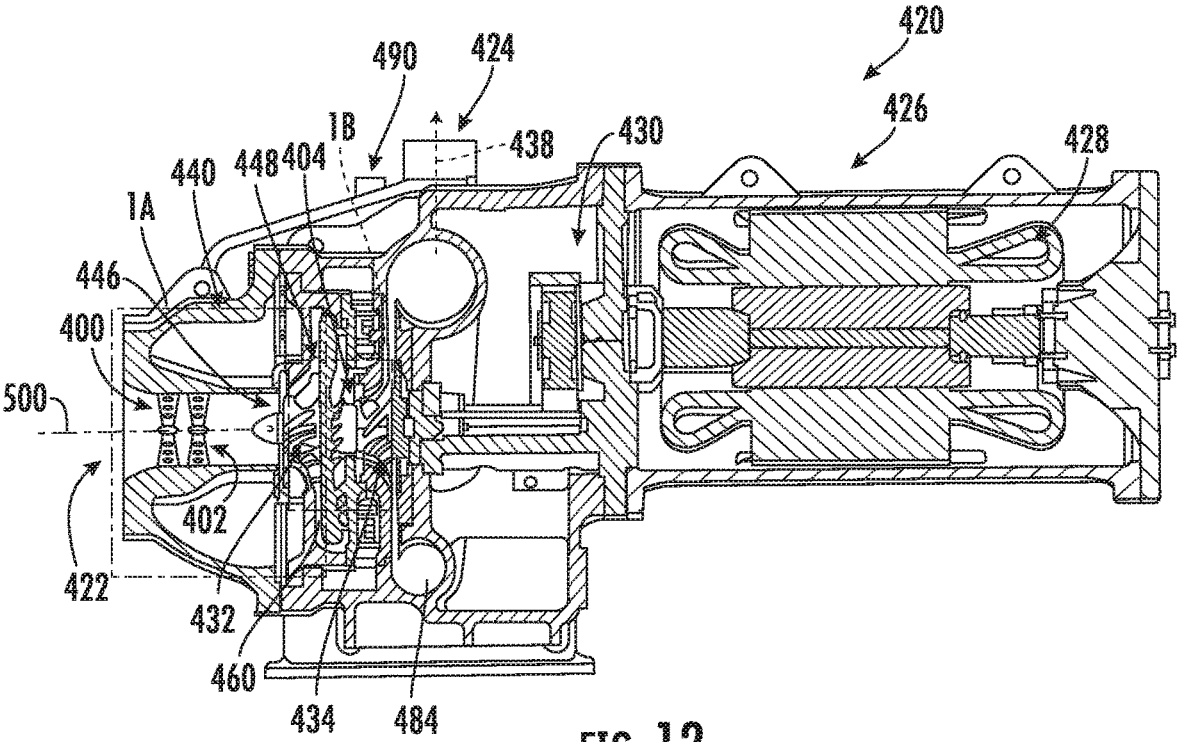
FIG. 12 schematically shows an example embodiment of a centrifugal compressor.

FIG. 12 schematically shows an example embodiment of a centrifugal compressor. FIG. 12 shows a centrifugal compressor 420 having an inlet or suction port 422 and an outlet or discharge port 424. The ports are formed along a housing (housing assembly) 426. The housing assembly may also contain a motor 428 (i.e., an electric motor having a stator and a rotor). The exemplary compressor is a two-stage indirect drive compressor wherein a gearbox or other transmission 430 intervenes between the motor and the impellers 432, 434 to drive the impellers about an axis 500 at a speed greater than the rotational speed of the motor rotor about its axis. As is discussed below, alternative compressors may include direct drive compressors, single stage compressors, and compressors where the two stages are at opposite ends of a motor, among yet further variations.

From inlet to outlet, a flowpath 438 through the compressor proceeds sequentially through an inlet housing 440 of the housing assembly. The exemplary inlet housing 440 may be based on one that contains an inlet guide vane (IGV) array. At the downstream end of the inlet housing is the inlet 446 to the first stage impeller 432. The inlet 446 is an axial inlet and the first stage impeller 432 has a radial outlet 448. The exemplary impeller 432 has a circumferential array of vanes extending between the inlet 446 and outlet 448 and extending between a hub and a shroud. Alternative impellers can be unshrouded. Flow from the first stage impeller outlet 448 proceeds radially outward through a diffuser 460 and then back radially inward through a return back axially to encounter inlet of the second stage impeller 434. The second stage impeller itself also has a radial outlet, hub, vanes, and an optional shroud. Flow discharged from the second stage impeller passes radially outward through a diffuser 82 into a discharge chamber or collector 484 and therefrom out the discharge port 424. Optionally, an intermediate port may be located along the flowpath. For injecting the swirl, injectors can protrude radially into the flowpath, which can promote efficient distribution of the injected refrigerant. In the FIG. 1 example, injectors 400 are reverse injectors upstream of forward injectors 402, and injectors 404 are forward injectors.

Figure 13:
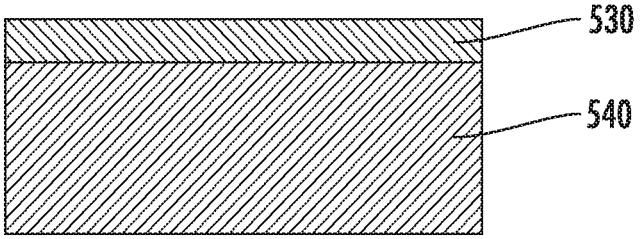
FIG. 13 schematically shows an example embodiment of a clad aluminum alloy.

As mentioned above, a surface of the compressor includes a cladding over a core, where the core comprises a first aluminum alloy and the cladding comprises a second aluminum alloy. The core/cladding surface can be on a compressor outer casing, an actuator, a fluid guide disposed around an actuator, a fluid guide not disposed around an actuator, one or more components of the prime mover, or any other external or internal component of any of the example embodiments of compressors described above. An example embodiment of a clad aluminum alloy surface is shown in FIG. 13, with a cladding 530 disposed over a core 540. Where used, the cladding can be disposed over the entirety of a relevant component or only a portion of the component. For example, in some embodiments, the cladding is disposed over the entirety of the outer casing. In some embodiments, the cladding is disposed over a portion of the outer casing.

The first aluminum alloy for the core 540 can be an aluminum alloy based material. In some embodiments, the aluminum alloy for the core 540 can be cast aluminum and can be made from aluminum alloys from AA200 series and AA300 series. Examples of cast aluminum alloys that can be used as core materials include but are not limited to AA242, AA295, AA355, AA356, AA360. It is noted that some cast alloying designations can also include a decimal and fourth digit that relates to a molded product form (e.g., AA242.x), and this fourth digit is omitted herein for ease of illustration. In some embodiments, the core can be wrought aluminum and can be made from aluminum alloys selected from 2000 series, 3000 series, 5000 series, or 6000 series aluminum alloys Examples of aluminum alloys that can be used as core materials include but are not limited to AA2024, AA3003, AA5052, AA6061. As used herein, all cast and wrought alloy numbers and alloy series numbers and individual alloy numbers are as specified and published by The Aluminum Association/ANSI.

The second aluminum alloy for the cladding 530 can be an aluminum alloy based material and, in some embodiments, may be made from aluminum alloys selected from 1000 series, 3000 series, 5000 series, 6000, or 7000 series aluminum alloys, including but not limited to AA1100, AA1145, AA3003, AA3102, AA5052, AA7072, AA8005, or AA8011. The second aluminum alloy of the outer cladding is less noble, than the first aluminum alloy. By "less noble", it is meant that the second aluminum alloy is galvanically anodic with respect to the first aluminum alloy, i.e., that the second alloy has a lower galvanic potential or a lower electrode potentials than the first aluminum alloy such that the second aluminum alloy would be anodic with respect to the first aluminum alloy in a galvanic cell. This allows the second aluminum alloy to provide sacrificial corrosion protection to the first aluminum alloy. In some embodiments, the difference in galvanic potential between the second aluminum alloy, and the nearest potential of the first aluminum alloy is in a range having a lower end of >0 V, 50 mV, or 150 mV, and an upper end of 400 mV, 650 mV, or 900 mV. These range endpoints can be independently combined to form a number of ranges, and each possible combination is hereby expressly disclosed. In some embodiments, the second aluminum alloy can be provided with reduced nobility by incorporating alloying elements such as zinc or magnesium.

In some embodiments, the second aluminum alloy can be provided with reduced nobility by incorporating alloying elements such as zinc or magnesium. In some embodiments where zinc is present, the zinc can be present in the second aluminum alloy at a level in a range with a lower end of >0 wt. %, 0.8 wt. %, or 4.0 wt. %, zinc and an upper end of 1.3 wt. %, 5.0 wt. %, or 10.0 wt. %. These range endpoints can be independently combined to form a number of ranges, and each possible combination (i.e., 0-1.3 wt. %, 0-5.0 wt. %, 0-10 wt. %, 0.8-1.3 wt. %, 0.8-5.0 wt. %, 0.8-10 wt. %, 4.0-5.0 wt. %, 4.0-10 wt. %, and excluding impossible combinations where a 'lower' endpoint would be greater than an 'upper' endpoint) is hereby expressly disclosed. In some embodiments where magnesium is present, the magnesium can be present in the second aluminum alloy at a level in a range with a lower end of >0 wt. %, 0.05 wt. %, 1.0 wt. %, 1.3 wt. % or 2.2 wt. %, and an upper end of 0.4 wt. %, 1.3 wt. %, 2.8 wt. %, or 4.9 wt. %. These range endpoints can be independently combined to form a number of ranges, and each possible combination is hereby expressly disclosed. The second aluminum alloy also includes one or more alloying elements selected from tin, indium, or gallium. In some embodiments, the selected alloying element(s) can be present in the second aluminum alloy at a level in a range with a lower end of 0.010 wt. %, 0.016 wt. %, or 0.020 wt. %, and an upper end of 0.020 wt. %, 0.035 wt. %, 0.050 wt. %, or 0.100 wt. %. These range endpoints can be independently combined to produce different possible ranges, each of which is hereby explicitly disclosed (i.e., 0.010-0.020 wt. %, 0.010-0.035 wt. %, 0.010-0.050 wt. %, 0.010-0.100 wt. %, 0.016-0.020 wt. %, 0.016-0.035 wt. %, 0.016-0.050 wt. %, 0.016-0.100 wt. %, 0.020-0.020 wt. %, 0.020-0.035 wt. %, 0.020-0.050 wt. %, 0.020-0.100 wt. %). The second alloy can also include one or more other alloying elements for aluminum alloys. In some embodiments, the amount of any individual other alloying element can range from 0-1.5 wt. %. In some embodiments, the total content of any such other alloying elements can range from 0-2.5 wt. %. Examples of such alloying elements include Si, Fe, Mn, Cu, Ti, or Cr. In some embodiments, the second aluminum alloy can have a composition consisting of: 4.0-6.0 wt. % zinc or magnesium, 0.01-0.05 wt. % of one or more alloying elements selected from tin, indium, gallium, or combinations thereof, 0-2.5 wt. % other alloying elements, and the balance aluminum.

The cladding 530 can be overlaid on the core 540 by techniques including but not limited to thermal spray (e.g., plasma spray, wire arc spray, high-velocity air fuel (HVAF) spray), electroplating, electroless plating, physical vapor deposition, and other cladding techniques such as roll cladding that can be used with some compressor component fabrication techniques (e.g., techniques involving wrought aluminum alloys). In some embodiments, the cladding can be applied via cold spray. In some embodiments, the cladding can be applied to a cast aluminum alloy surface via cold spray. In a cold spray process, unmelted metal particles are introduced into a high velocity gas stream being projected out of a high velocity (e.g., supersonic) nozzle toward the coating substrate target. The particles' kinetic energy provides sufficient heat on impact with the coating substrate such that the particles plastically deform and fuse with the substrate and surrounding deposited metal material. As the particles impact the substrate, they rapidly cool even as the particles are deforming. The particles change shape dramatically from relatively round to very thin flat splats on the surface. Cold spray can be applied by supplying metal powder from powder feeder to a spray gun that include a nozzle and a heater. Powder particle diameter sizes can range from 1 to 120 microns, more specifically from 5 to 75. Pressurized gas (e.g., helium, nitrogen) is fed from a gas pre-heater to the gun heater. The powder and the gas streams are mixed in the gun and accelerated to supersonic speeds as the gas/powder mixture exits the gun nozzle. The term "cold" in "cold spray deposition" refers to the fact that the gas is maintained at a temperature below the melting point of the metal powder; however, as described above the gas is heated in both the gas pre-heater and the gun heater. In some embodiments, the temperature of the gas used in the process can range from 0° C. to 670° C., and gas pressure can range from 5 bar to 60 bar.

Figure 14:
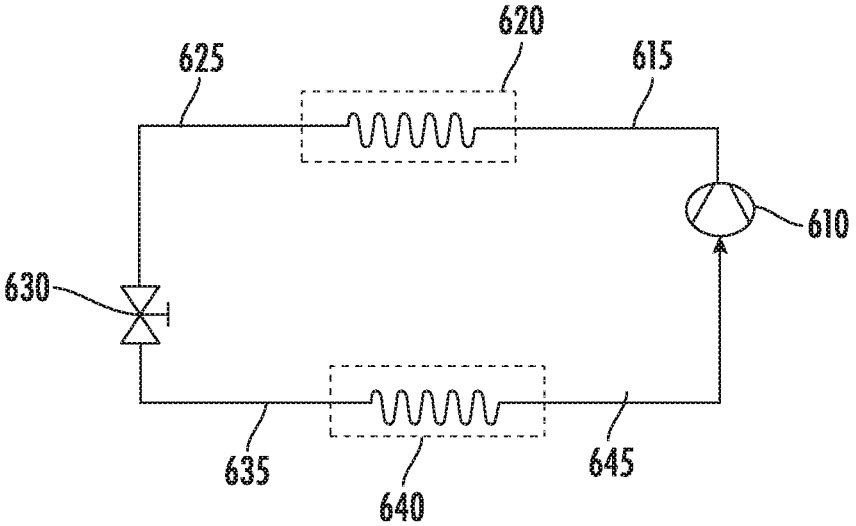
FIG. 14 schematically shows a heat transfer system.

In some embodiments, the compressors disclosed herein are used in a heat transfer system. Referring now to the FIG. 14, an exemplary heat transfer system with a heat transfer fluid circulation loop is schematically shown in block diagram form. As shown in FIG. 14, a compressor 610 pressurizes a refrigerant or heat transfer fluid in its gaseous state (e.g., a fluorocarbon), which both heats the fluid and provides pressure to circulate it throughout the system. The hot pressurized gaseous heat transfer fluid exiting from the compressor 610 flows through conduit 615 to heat rejection heat exchanger 620, which functions as a heat exchanger to transfer heat from the heat transfer fluid to the surrounding environment, resulting in condensation of the hot gaseous heat transfer fluid to a pressurized moderate temperature liquid. The liquid heat transfer fluid exiting from the heat rejection heat exchanger 620 (e.g., a condenser) flows through conduit 625 to expansion valve 630, where the pressure is reduced. The reduced pressure liquid heat transfer fluid exiting the expansion valve 630 flows through conduit 635 to heat absorption heat exchanger 640 (e.g., an evaporator), which functions as a heat exchanger to absorb heat from the surrounding environment and boil the heat transfer fluid. Gaseous heat transfer fluid exiting the heat rejection heat exchanger 640 flows through conduit 645 to the compressor 610, thus completing the heat transfer fluid loop. The heat transfer system has the effect of transferring heat from the environment surrounding the evaporator 640 to the environment surrounding the heat rejection heat exchanger 620. The thermodynamic properties of the heat transfer fluid allow it to reach a high enough temperature when compressed so that it is greater than the environment surrounding the condenser 620, allowing heat to be transferred to the surrounding environment. The thermodynamic properties of the heat transfer fluid must also have a boiling point at its post-expansion pressure that allows the environment surrounding the heat rejection heat exchanger 640 to provide heat at a temperature to vaporize the liquid heat transfer fluid.

The heat transfer system shown in FIG. 14 can be used as an air conditioning system, in which case the exterior of compressor 610 is contacted with air in the surrounding outside environment. Additionally, as is known in the art, the system can also be operated in heat pump mode using a standard multiport switching valve to reverse heat transfer fluid flow direction and the function of the condensers and evaporators, i.e. the condenser in a cooling mode being evaporator in a heat pump mode and the evaporator in a cooling mode being the condenser in a heat pump mode. Additionally, while the heat transfer system shown in FIG. 14 has evaporation and condensation stages for highly efficient heat transfer, other types of heat transfer fluid loops are contemplated as well, such as fluid loops that do not involve a phase change, for example, multi-loop systems such as commercial refrigeration or air conditioning systems where a non-phase change loop thermally connects one of the heat exchangers in an evaporation/condensation loop like FIG. 14 to a surrounding outside environment or to an interior environment to be conditioned. In some embodiments, heat transfer fluid circulation loops can have at least a portion of the loop that operates below atmospheric pressure, which can render the system susceptible to water ingress to the loop and resultant corrosion. Accordingly, in some embodiments, a technical effect of corrosion sacrificial corrosion protection can be provided by including the clad aluminum alloy on a fluid guide surface in the compressor for a sub-atmospheric pressure system.

To the extent used herein, the term "about" is intended to include the degree of error associated with measurement of the particular quantity based upon the equipment available at the time of filing the application. For example, "about" can include a range of +8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A compressor comprising:

an outer casing;

a fluid guide around a cavity within the outer casing;

an inlet in operative fluid communication with the cavity;

an outlet in operative fluid communication with the cavity; and a prime mover, including an actuator in the cavity, said actuator including a surface arranged to receive fluid in the cavity from the inlet, impart compression to the received fluid in the cavity, and discharge compressed fluid to the outlet, wherein a surface of the compressor includes a cladding over a core, said core comprising a first aluminum alloy, and said cladding comprising a second aluminum alloy, wherein the second aluminum alloy is less noble than the first aluminum alloy and comprises an alloying element selected from tin, indium, gallium, or combinations thereof.

2. The compressor of claim 1, wherein the surface of the compressor is a surface of the outer casing, the cladding is disposed on the surface of the outer casing.

3. The compressor of claim 1, wherein the surface of the compressor is a surface of the fluid guide, the cladding is disposed on the surface of the fluid guide around the cavity.

4. The compressor of claim 1, wherein the surface of the compressor is the surface of the actuator, the cladding is disposed on the surface of the actuator.

5. The compressor of claim 1, wherein the surface of the compressor is a surface of the inlet or a surface of the outlet, the cladding is disposed on the surface of the inlet or on the surface of the outlet.

6. The compressor of claim 1, wherein the cladding comprises a cast aluminum alloy.

7. The compressor of claim 1, wherein the prime mover is disposed within the outer casing.

8. The compressor of claim 1, wherein the prime mover is disposed outside of the outer casing, in operative mechanical communication with the actuator in the outer casing.

9. The compressor of claim 1, wherein the actuator is selected from a reciprocating piston, a rotary screw, a scroll, a rotary vane, or an impeller.

10. The compressor of claim 1, wherein the second aluminum alloy further comprises zinc or magnesium.

11. The compressor of claim 1, wherein the alloying element selected from tin, indium, gallium, or combinations thereof, is present in the second aluminum alloy at a level of between 0.01 wt. % and 0.1 wt. %.

12. The compressor of claim 1, wherein the second aluminum alloy has a composition consisting of 4.0-6.0 wt. % of zinc or magnesium, 0.01-0.05 wt. % of the alloying element selected from tin, indium, gallium, or combinations thereof, 0-2.5 wt. % of other alloying elements, and a balance of aluminum.

13. The compressor of claim 1, wherein the second aluminum alloy further comprises 4.0 wt. % to 10.0 wt. % of zinc or 2.2 wt. % to 4.9 wt. % of magnesium.

14. The compressor of claim 1, wherein the second aluminum alloy does not comprise Cu.

15. The compressor of claim 1, wherein the second aluminum alloy further comprises Cu in an amount of greater than 0 wt. % and less than or equal to 1.5 wt. %.

16. A heat transfer system comprising a heat transfer fluid circulation loop including the compressor of claim 1, a heat rejection heat exchanger in thermal communication with a heat sink, an expansion device, and a heat absorption heat exchanger in thermal communication with a heat source, connected together in order by a conduit.

17. The heat transfer system of claim 16, wherein the heat source is an indoor conditioned air space and the heat sink is an outdoor air space.

18. The heat transfer system of claim 17, wherein the compressor is in disposed in the outdoor air space.

19. The heat transfer system of claim 17, wherein the compressor is disposed in an indoor air space separate from the indoor conditioned air space, and is exposed to an external source of moisture.

20. The heat transfer system of claim 16, wherein the heat transfer fluid circulation loop is configured for an operational pressure of less than atmospheric pressure in at least a portion of the heat transfer fluid circulation loop.

* * * * *